US005425511A

United States Patent [19]

Pepe

[11] Patent Number: 5,425,511

[45] Date of Patent: Jun. 20, 1995

[54] APPARATUS FOR REELING

[75] Inventor: David Pepe, Meriden, Conn.

[73] Assignee: Davis Electric Wallingford Corporation, Wallingford, Conn.

[21] Appl. No.: 90,296

[22] Filed: Jul. 12, 1993

[51] Int. Cl.[6] ..... B65H 75/00

[52] U.S. Cl. ..... 242/399.1; 242/470; 242/559.4; 242/596.7

[58] Field of Search ..... 242/399.1, 470, 533, 242/559.4, 596.1, 592, 596.7

[56] References Cited

U.S. PATENT DOCUMENTS

| | | | |
|---|---|---|---|
| 1,869,545 | 8/1932 | Crafts | 242/596.1 |
| 2,505,567 | 4/1950 | Moody | 57/1 |
| 2,641,413 | 6/1953 | Bruestle | 242/470 |
| 2,706,057 | 4/1955 | Belding . | |
| 2,737,303 | 3/1956 | Held . | |
| 3,123,314 | 3/1964 | Bruestle . | |
| 3,458,185 | 7/1969 | Mereril | 270/31 |
| 3,687,385 | 8/1972 | Skalleberg . | |
| 3,876,087 | 4/1975 | Osta . | |
| 4,026,483 | 5/1977 | Skalleberg | 242/25 R |
| 4,030,704 | 6/1977 | Beierle et al. . | |
| 4,098,468 | 7/1978 | Skalleberg . | |
| 4,371,308 | 2/1983 | Skalleberg | 414/416 |
| 4,431,140 | 2/1984 | Tetro . | |
| 4,609,160 | 9/1986 | Linderoth et al. . | |
| 4,616,469 | 10/1986 | Skalleberg | 53/410 |
| 4,679,743 | 7/1987 | Dallmaier | 242/470 |
| 4,848,697 | 7/1989 | Skalleberg | 242/158 R |
| 5,246,180 | 9/1993 | Berry et al. | 242/596.7 |
| 5,267,702 | 12/1993 | Schumacher et al. | 242/592 |
| 5,288,031 | 2/1994 | Linderoth | 242/470 |
| 5,333,809 | 8/1994 | Berry et al. | 242/592 X |

*Primary Examiner*—John M. Jillions
*Attorney, Agent, or Firm*—McCormick, Paulding & Huber

[57] ABSTRACT

An apparatus is provided for reeling cables, wires and other flexible members. A first side frame and a second side frame are moveable relative to each other to receive and support a reel between them. Each side frame includes a cradle defining at least part of a pintle aperture for receiving a respective pintle. Each pintle is rotatably mounted on a linkage assembly, and extends through a respective pintle aperture toward the opposing frame, and is moveable in at least two directions within a vertical plane relative to the adjacent cradle for aligning the pintle with a center hole of a reel. A lift motor is coupled to both side frames for substantially simultaneously moving both side frames relative to the ground, and in turn driving the cradles into engagement with the pintles to lift the pintles and a reel supported on the pintles above ground. A pintle drive motor is mounted on the first side frame and coupled to the respective pintle for rotating the pintle upon operation of the drive motor, and in turn rotating the reel supported on the pintles. A chain is coupled between the driven pintle and the drive motor, and guide members are supported adjacent the chain to prevent uncoupling of the chain from the driven pintle, upon movement of the driven pintle relative to the drive motor when aligning the driven pintle with the center hole of a reel.

36 Claims, 5 Drawing Sheets

APPARATUS FOR REELING

FIELD OF THE INVENTION

The present invention relates to apparatus for reeling cables, wires and other flexible members, and more particularly, to such apparatus for lifting reels, and for the payoff and take-up of reels.

BACKGROUND INFORMATION

In the manufacture, transportation, and storage of cables, wires and other flexible structures, the cables or wires are typically wound in continuous lengths on reels, and the reels are supported on reeling devices. The reeling devices are used to lift, transport and/or store the wound cables or wires. A typical prior reeling device includes vertically-oriented side frames mounted on wheels, which are coupled together on their upper ends by a shaft permitting the side frames to move relative to each other to accommodate a reel between them. A pair of spindles are each supported from a respective side frame, and each spindle is received within one end of a center hole extending through the reel. Once the spindles are received into either end of the center hole, the spindles are then lifted up, typically by a motor and drive mechanism, which in turn lifts the reel off the ground. The reel can then be transported on the portable reeling device, and the reel is rotatable on the spindles for payoff and take-up of the cable or wire.

It often is difficult to align the spindles with the center hole of a reel in order to mount the reel on this type of prior reeling device. The reels frequently weigh many thousands of pounds, and the reeling device itself is a heavy, sturdy structure, in order to adequately support the reels. Thus, it is often difficult to manipulate either the reel or the reeling device in order to align the spindles with the center hole of the reel. Typically, the ground upon which the reel is sitting is uneven, or the reel itself does not sit so that the center hole is, or can be aligned with the spindles on the reeling device. Frequently the axis of the center hole is oriented at an angle with respect to the axis of the spindles, thus requiring maneuverability of the spindles relative to the reel, or vice-versa, in order to align the spindles with the center hole to support the reel on the reeling device.

In a prior reeling device shown in U.S. Pat. No. 4,098,468 to Skalleberg, dated Jul. 4, 1978, the spindles are movable relative to the reel in order to align the spindles with the center hole and mount the reel. In the '468 patent, each spindle is suspended on one end of a cable, which is coupled on the other end to a separate drive motor for the respective cable. In the situation where the spindles must be rotatably driven for payoff and/or take-up of the reel, the drive motors, transmissions and other necessary drive mechanisms are also suspended from the cables with the spindles. This substantially increases the total weight suspended from each cable, and the total mass associated with each spindle, which in turn renders each spindle difficult to maneuver and align with respect to the center hole of a reel. Also, because each spindle is suspended on a separate cable, a separate drive motor is required for each spindle in order to lift each spindle, which can be a significant additional expense.

It is an object of the present invention to overcome the drawbacks and disadvantages of prior reeling devices.

SUMMARY OF THE INVENTION

The present invention is directed apparatus for reeling cable, wires and other flexible members. In one embodiment of the present invention, the apparatus comprises a first side frame, and a second side frame spaced apart from the first side frame and coupled to the first side frame. The first and second side frames define a space between them, and the first side frame includes a first support surface, and the second side frame includes a second support surface. A first pintle member is rotatably mounted on a first support member coupled to the first side frame, and projects outward from the first side frame above the first support surface and is directed generally toward the second side frame The first pintle member is moveable in at least two directions in a vertical plane relative to the first support surface for aligning the first pintle member with the center hole of a reel. A second pintle member is rotatably mounted on a second support member coupled to the second side frame. The second pintle member projects outward from the second side frame and is directed generally toward the first side frame, and is moveable in at least two directions within a vertical plane relative to the second support surface for aligning the second pintle member with the center hole of the reel. A lift motor of the apparatus is coupled to the first side frame and to the second side frame for substantially simultaneously moving the first and second side frame relative to the ground, and in turn driving the first and second support surfaces into engagement with the first and second pintle members, respectively, to move the first and second pintle members and the reel supported on the first and second pintle members above the ground.

In one embodiment of the present invention, the apparatus further comprises a first drive unit coupled to the first side frame and to the lift motor for moving the first side frame relative to the ground in response to operation of the lift motor. A second drive unit is also coupled to the lift motor for moving the second side frame relative to the ground in response to operation of the lift motor. In one embodiment of the present invention, the first drive unit includes a first drive screw coupled to the lift motor and to the first side frame, and rotatable in response to operation of the lift motor to move the first side frame relative to the ground. A second drive screw is coupled to the lift motor and to the second side frame, and is rotatable in response to operation of the lift motor to move the second side frame relative to the ground.

In one embodiment of the present invention, the lift motor is mounted to the first side frame, and the apparatus further comprises a drive shaft coupled between the lift motor and the second drive unit and extending between the first and second side frame. The drive shaft includes a first shaft section and at least one second shaft section movable relative to the first shaft section, in order to adjust the length of the drive shaft in response to movement of the first side frame relative to the second side frame.

In another embodiment of the present invention, the apparatus comprises a first frame member and a second frame member spaced apart from the first frame member, and the first and second frame members are movable relative to each other for receiving a reel between them. A pintle drive motor is mounted on the first frame member and fixed with respect to the first frame member. A drive pintle is rotatably mounted on a support member and coupled to the drive motor for rotation of the drive pintle in response to operation of the drive motor, in order to rotate a reel supported on the drive pintle for payoff and/or take-up of the reel. The support member is coupled to the first frame member and movable with the drive pintle in at least two directions within a vertical plane relative to the first frame member and the drive motor in order to align the drive pintle with the center hole of a reel.

In this embodiment of the present invention, the apparatus preferably further comprises a flexible drive member coupled between the drive pintle and the drive motor for rotating the drive pintle in response to operation of the drive motor. A first guide member is supported on the first support member adjacent to the flexible drive member, and spaced apart from the flexible drive member a distance sufficient to permit rotation of the flexible drive member in response to operation of the drive motor, and to prevent uncoupling of the flexible drive member from the drive pintle upon movement of the drive pintle relative to the drive motor.

In another embodiment of the present invention, the flexible drive member is coupled to an output shaft coupled to the drive motor for rotation of the output shaft and the flexible drive member in response to operation of the drive motor. A second guide member is mounted adjacent to the output shaft and is spaced apart from the flexible drive member a distance sufficient to permit rotation of the flexible drive member in response to operation of the drive motor, and to prevent uncoupling of the flexible drive member from the output shaft upon movement of the drive pintle relative to the drive motor. In this embodiment of the present invention, the flexible drive member is either a chain or a drive belt, and each of the first and second guide members is spaced apart from the flexible drive member a distance less than approximately a thickness of the flexible drive member.

In another embodiment of the present invention, a locking unit is coupled between the first frame member and the drive pintle for pressing the drive pintle into engagement with a support surface on the first frame member to prevent movement of the drive pintle relative to the first frame member. The locking unit may include a cylinder and a shaft mounted within the cylinder and engageable on one end with the support member. The shaft is movable in response to actuation of the cylinder to engage the support member, and in turn press the drive pintle into engagement with the support surface.

One advantage of the apparatus of the present invention, is that the pintles are driven relative to the ground to lift the reel above the ground, by driving the side frames upward, which in turn drives the cradle or support surfaces of the side frames into engagement with the pintles and elevates the pintles and the reel above the ground. As a result, only one lift motor is necessary to drive both side frames, and thus lift both pintles relative to the ground. This represents a substantial cost savings in comparison to prior art reeling devices requiring separate lift motors and drive mechanisms associated with each lift motor for each pintle, in order to drive the pintles upward and lift a reel above the ground.

Another advantage of the apparatus of the present invention, is that the drive pintle is independently mounted with respect to the drive motor, and other drive mechanisms, such as transmissions or reducers, and therefore the drive pintle can be easily maneuvered by an operator to align the drive pintle with the center hole of a reel. The drive pintle is coupled to the drive motor and other drive components preferably by a flexible drive member, such as a chain or drive belt, and means are provided for maintaining a drive connection between the flexible drive member and the drive components. The means for maintaining a drive connection, such as one or more guide members mounted adjacent to the flexible drive member, permit the drive pintle to be easily maneuvered in at least two directions within a vertical plane relative to the side frame and the support surface of the side frame, in order to align the drive pintle with the center hole of the reel while simultaneously preventing the flexible drive member from being uncoupled from the drive pintle. Because the drive pintle is freely suspended, and moveable with respect to the drive components for rotating the drive pintle, the drive pintle can be easily maneuvered and aligned with the center hole of a reel.

In prior art reeling devices, on the other hand, wherein the drive components are coupled to the drive pintle and suspended with the drive pintle, the drive pintle is extremely heavy, and difficult to maneuver and align with the center hole of a reel because the operator is not only required to move the drive pintle, but is also required to move the heavy drive components mounted with the pintle. The drive pintle in the apparatus of the present invention is therefore substantially easier to maneuver and align in comparison to such prior art devices.

Other advantages of the apparatus of the present invention will become apparent in view of the following detailed description and accompanying drawings.

DETAILED DESCRIPTION

Figure 1A:
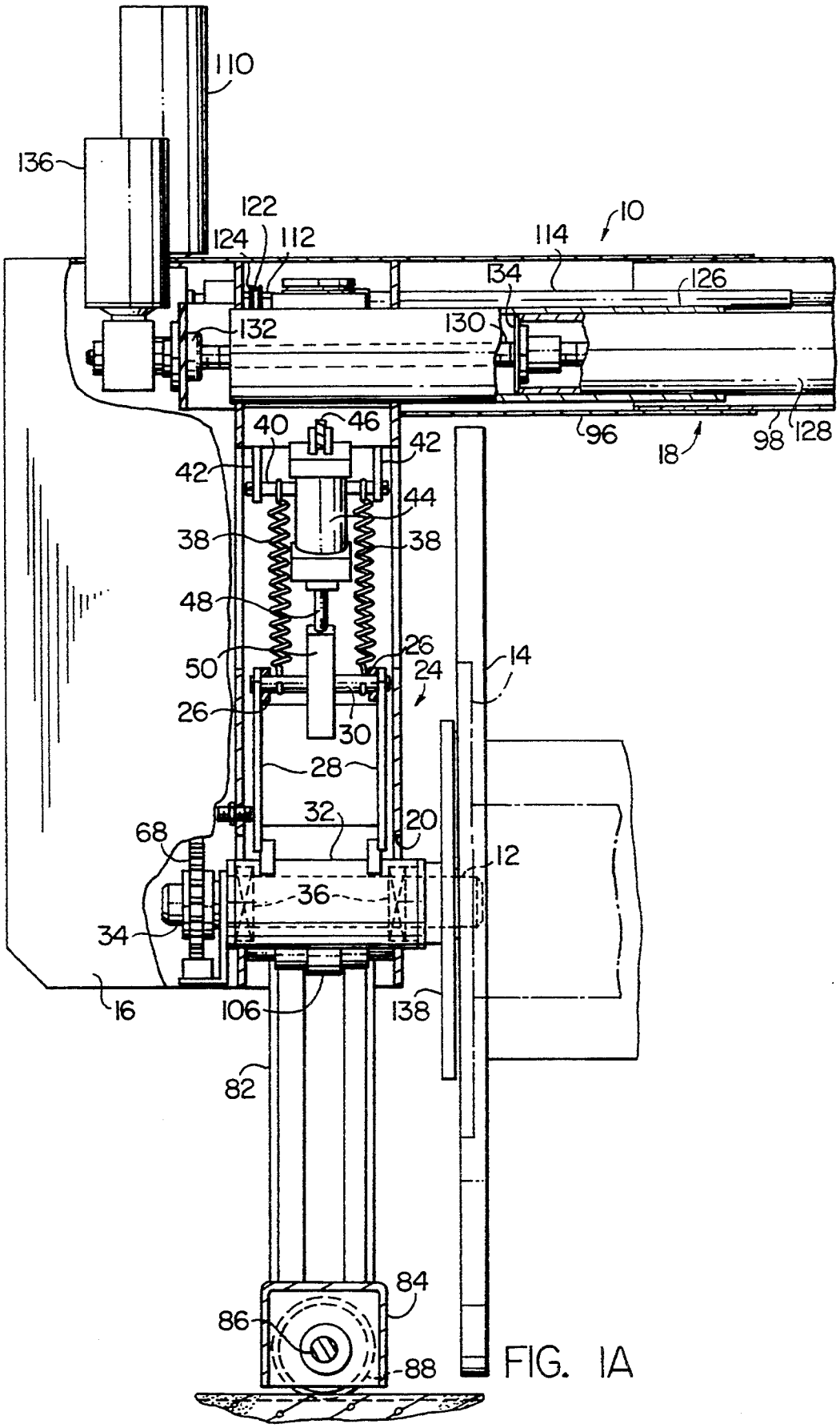
FIG. 1A is a front plan view of the left side of an apparatus embodying the present invention, in partial cross-section, for reeling cables, wires and other flexible members.
Figure 1B:
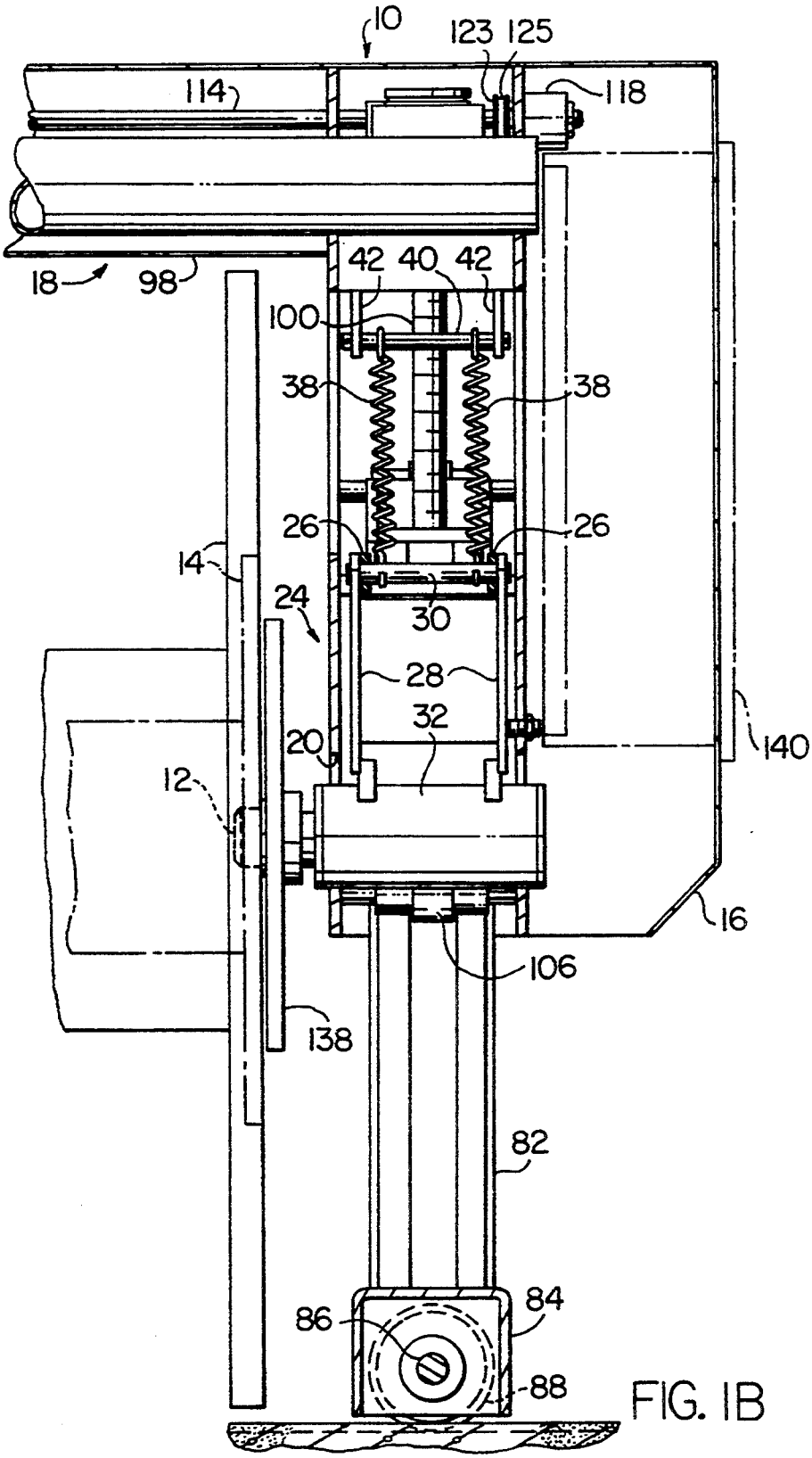
FIG. 1B is a front plan view, in partial cross-section, of the right side of the apparatus of FIG. 1A.

In FIGS. 1A and 1B, a reeling apparatus embodying the present invention is indicated generally by the reference numeral 10. The apparatus 10 includes a pair of spindles or pintles 12 for lifting and supporting a reel 14. The reel 14 can be of different sizes, as illustrated in broken lines in FIGS. 1A and 1B. Each pintle 12 is supported within a respective side frame 16, and the two side frames are coupled together on their upper ends by a top frame 18. The top frame 18 has a telescopic construction in order to adjust the distance between the side frames 16, and the side frames are also adjustable in elevation in order to accommodate different size reels between them.

Figure 2:
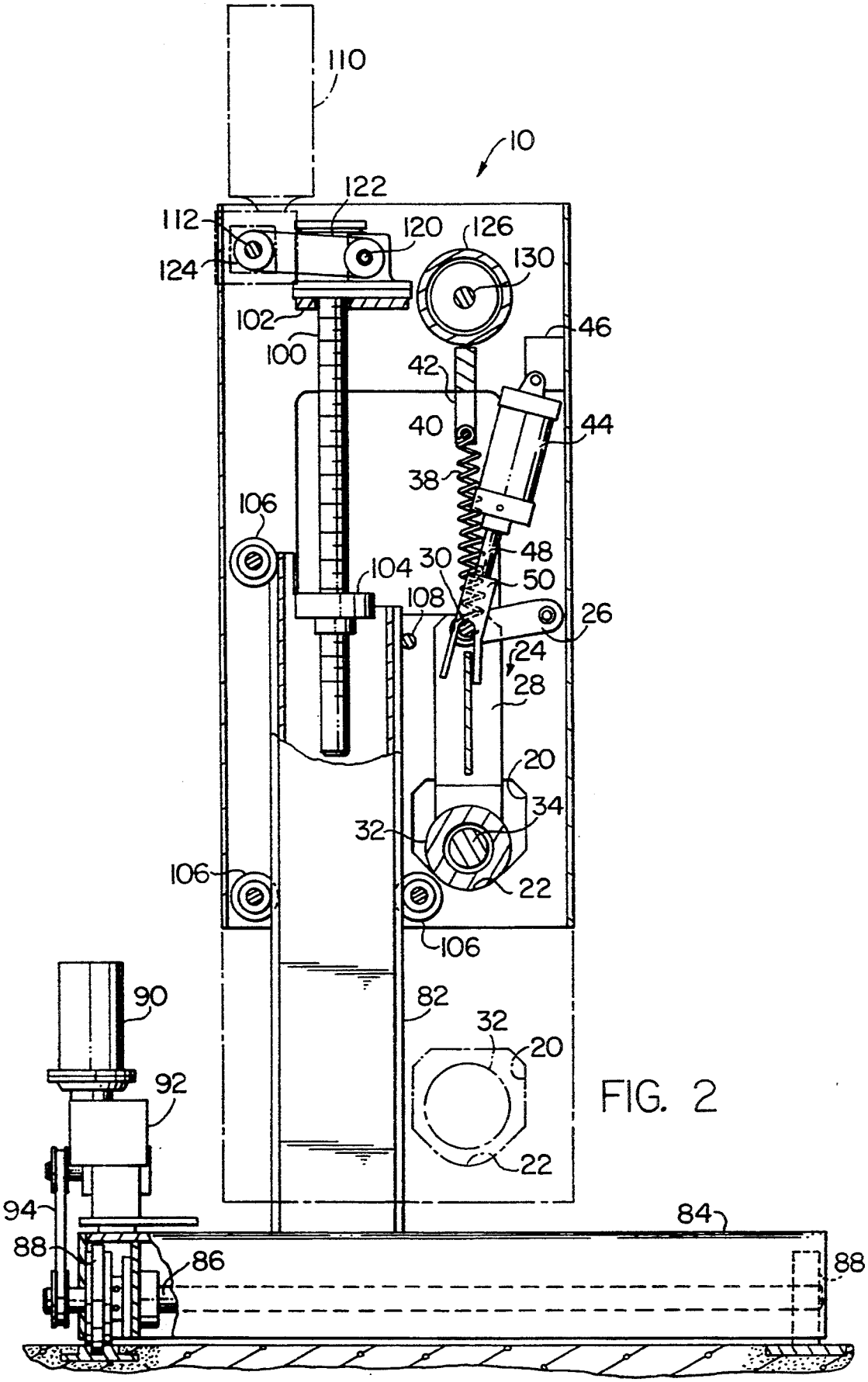
FIG. 2 is a side plan view, in partial cross-section, of the apparatus of FIG. 1A.

As shown in FIG. 2, each pintle 12 extends through a respective pintle aperture 20 formed within an inside wall of the respective side frame 16. Each pintle aperture 20 is defined by larger dimensions in both the vertical and horizontal directions than is the pintle structure received through the respective aperture, in order to allow freedom of movement of the pintle 12 within the pintle aperture for aligning the pintle with the center hole in the reel 14, as is described further below. As shown in FIG. 2, the bottom surface defining each pintle aperture 20 forms a cradle 22, which is defined by a curvature substantially conforming to the curvature of the respective pintle 12, in order to receive and support the respective pintle after the pintles are received within the center hole of the reel 14 and to lift and support the reel.

Each pintle 12 is supported by a linkage assembly 24 within the respective side frame 16, which includes a pair of idler links 26 and a pair of suspension links 28, as shown more clearly in FIG. 1A. Each idler link 26 is pivotally mounted on one end within the respective side frame 16, and is coupled on the other end to a pivot shaft 30. The suspension links 28 are each coupled on one end to the pivot shaft 30, on opposite sides of the idler links 26 relative to each other, and each is coupled on the other end to a pintle housing 32. A pintle shaft 34 extends through each pintle housing 32, and is journaled on either end by bearings 36. Each pintle 12 is coupled to one end of the respective pintle shaft 34, and is rotatable within the respective pintle housing 32 to permit payoff and take-up of the reel 14 when supported on the pintles.

Each linkage assembly 24 is supported by a pair of suspension springs 38 within the respective side frame 16. The suspension springs 38 are each coupled on one end to the shaft 30 and coupled on the other end to a support shaft 40, which is in turn mounted to a wall of the respective side frame 16 by supports 42. Each pintle 12 is thus suspended within the respective pintle aperture 20 by the linkage assembly 24 and springs 38, and when not engaged within the center hole of a reel 14, each pintle is permitted to move freely in any direction within the respective pintle aperture 20 for easy manual maneuverability and alignment with a center hole of a reel.

A pneumatic cylinder 44 is pivotally coupled on one end to a wall of the left side frame 16 by a support 46, and a drive shaft 48 of the cylinder 44 is coupled to a fork 50. As shown in FIG. 2, the opening defined between the two prongs of the fork 50 is dimensioned to receive the pivot shaft 30 of the adjacent linkage assembly 24. Actuation of the cylinder 44 drives the fork 50 into engagement with the pivot shaft 30, which drives the suspension links 28 downward, and in turn drives the left pintle 12 into engagement with the cradle 22. The cylinder 44 is actuated into engagement with the linkage assembly after the left pintle 12 in FIG. 1A is received within the center hole of a reel 14, to prevent any upward movement of the pintle and/or dampen any vibrational movements of the pintle during operation.

This feature is particularly advantageous when the apparatus 10 includes a drive mechanism for rotatably driving the pintle 12 for payoff and/or take-up of the reel 14, as is described further below, since it prevents or dampens vibrational movements of the pintle which might otherwise interfere with or damage the drive mechanism. In the embodiment of the present invention illustrated, it is only necessary to include one cylinder 44 for engaging the linkage assembly of the pintle being driven (i.e., the left pintle in FIG. 1A). The other pintle assembly is idle, as is described further below, and therefore does not require the cylinder and fork assembly for proper operation.

Figure 3:
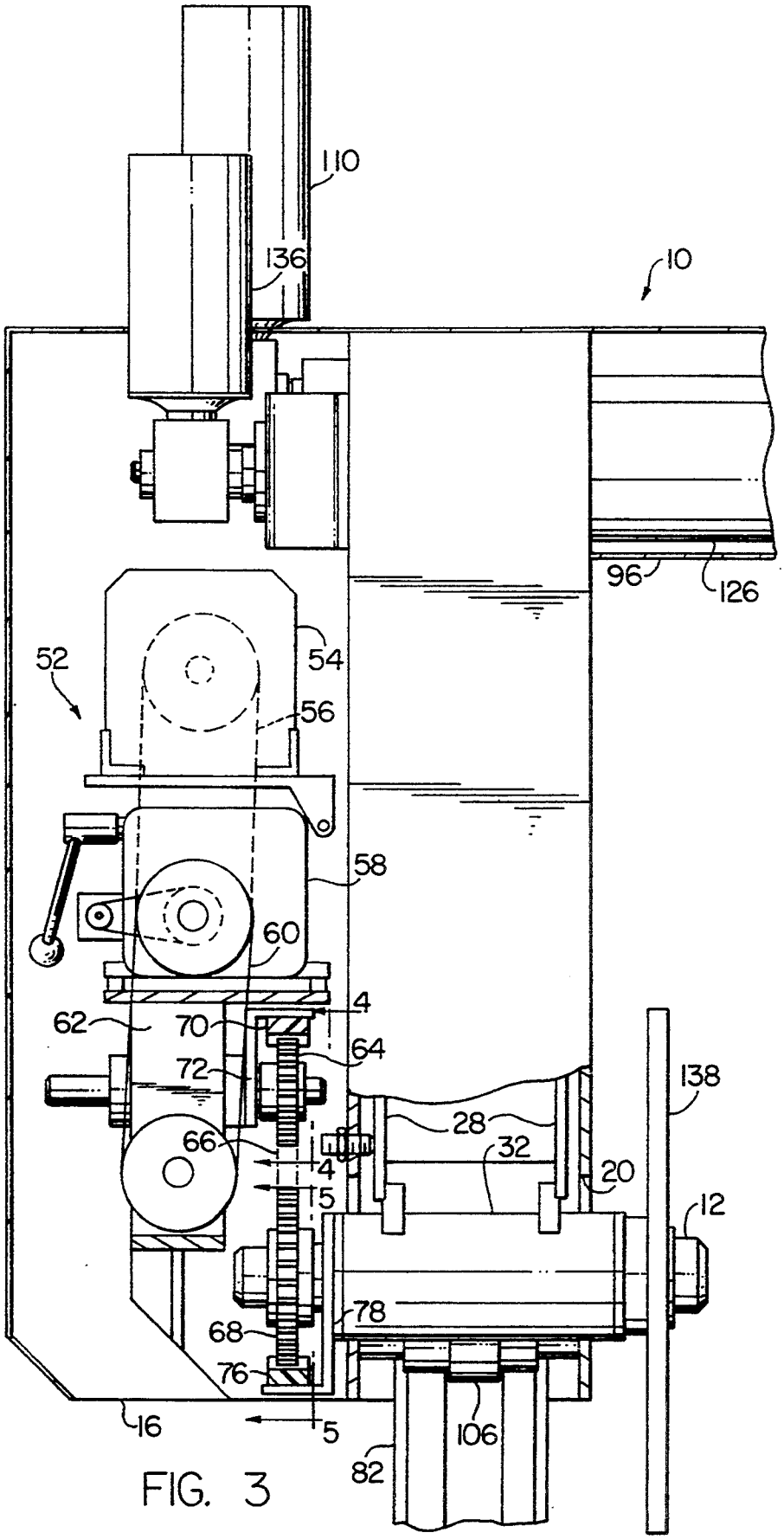
FIG. 3 is a partial cross-sectional view of the apparatus of FIG. 1A, illustrating the drive motor and other drive components for driving the drive pintle of the apparatus of FIG. 1A.

As shown in FIG. 3, a drive assembly 52 is mounted within the left side frame 16 in FIG. 1A, and is coupled to the left pintle 12, which is referred to as the "drive pintle", to rotatably drive the pintle. The drive assembly 52 includes a drive motor 54, which is coupled by a chain or drive belt 56 to a transmission 58, and the transmission is in turn coupled by a chain or drive belt 60 to a reducer 62. The output shaft of the reducer 62 includes a first sprocket 64 coupled to a chain or drive belt 66, which is in turn coupled to a second sprocket 68 mounted on the other end of the drive pintle shaft 34. Operation of the drive motor 54 causes rotation of the drive pintle 12, which in turn rotates the reel 14 for payoff or take-up of the reel depending upon the direction of rotation of the drive pintle. The speed and direction of rotation of the drive pintle is controlled by selection and control of the transmission 58 and reducer 62 in a manner known to those skilled in the art.

The drive motor 54, transmission 58, and reducer 62 are each mounted to a wall of the left side frame 16 and are fixed in place with respect to the side frame. Thus, when the drive pintle 12 is not seated within the center hole of a reel 14, it is permitted to move freely within the pintle aperture 20 and relative to the components of the drive assembly 52, to permit easy manual movement and maneuverability of the drive pintle 12 when aligning the pintle with the center hole of a reel 14.

Figure 5:
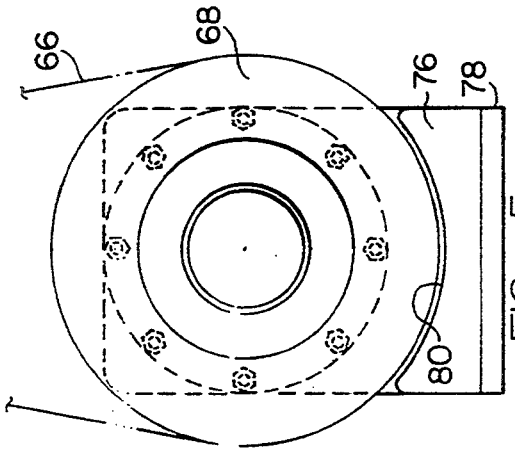
FIG. 5 is an enlarged partial plan view taken along the line 5—5 of FIG. 3, illustrating another guide member mounted adjacent to the chain or drive belt and the drive pintle, for preventing the chain or drive belt from becoming disengaged upon movement of the drive pintle relative to the drive motor.
Figure 4:
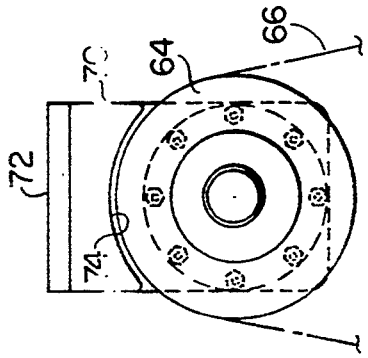
FIG. 4 is an enlarged partial plan view taken along the line 4—4 of FIG. 3, illustrating the guide member for preventing the chain or drive belt coupled between the drive motor and the drive pintle from becoming disengaged upon movement of the drive pintle relative to the drive motor.

The apparatus 10 also includes means for maintaining a drive connection between the drive assembly 52 and the drive pintle 12, while permitting freedom of movement of the drive pintle relative to the drive assembly when aligning the drive pintle. As shown in FIGS. 3 and 4, a first guide member 70 is mounted on a first bracket 72, which is in turn mounted on one end to the reducer 62 adjacent to the output shaft of the reducer. As shown in FIG. 4, the first guide member 70 includes a guide surface 74 spaced closely to the first sprocket 64 and chain 66, which defines a curvature substantially conforming to the curvature of the chain and first sprocket. As shown in FIGS. 3 and 5, a second guide member 76 is mounted on a second bracket 78, which is in turn mounted on one end to the pintle housing 32 adjacent the pintle drive shaft 34. The second guide member 76 includes a guide surface 80 spaced closely to the second sprocket and chain, and which defines a curvature substantially conforming to the outside curvature of the second sprocket and chain.

The guide members 70 and 76 permit movement of the drive pintle 12 relative to the drive assembly 52, while maintaining the drive connection of the chain 66 between the first and second sprockets 64 and 68, respectively. As the drive pintle 12 is moved closer to the first sprocket 64 of the reducer 62, the first and second guide members 70 and 76, respectively, prevent the chain 66 from becoming dislodged from the first and second sprockets 64 and 68, respectively, due to any slack that develops within the chain. Each guide member 70 and 76 is spaced sufficiently close to the respective sprocket to prevent the chain from slipping between the sprocket and the guide member. The distance between each guide surface and the chain is less than the height or thickness of the chain.

One advantage of this feature is that the drive connection is maintained between the drive pintle 12 and the drive assembly 52, yet the drive pintle can be easily maneuvered because it is relatively light in weight and is freely suspended by the linkage assembly 24. In other reeling devices, in which the drive assembly is suspended with the drive pintle, the combination of the drive assembly and drive pintle is relatively heavy, and thus more difficult to maneuver in comparison to the apparatus of the present invention when attempting to align the drive pintle with the center hole of a reel.

Turning again to FIGS. 1A, 1B and 2, each side frame 16 is mounted on one end of a respective side support member 82, the other end of which is mounted on a respective base frame 84. Each base frame 84 includes a shaft 86 journaled within the frame and extending along the length of the frame, and a pair of wheels 88 mounted on either end of the shaft. As shown in FIG. 2, the left base frame 84 includes a drive motor 90, which is coupled to a reducer 92 having an output shaft coupled to a chain or drive belt 94, which is in turn coupled to the respective shaft 86. Operation of the drive motor 90 rotates the drive shaft 86, which in turn drives the wheels 88 to move the apparatus.

Figure 6:
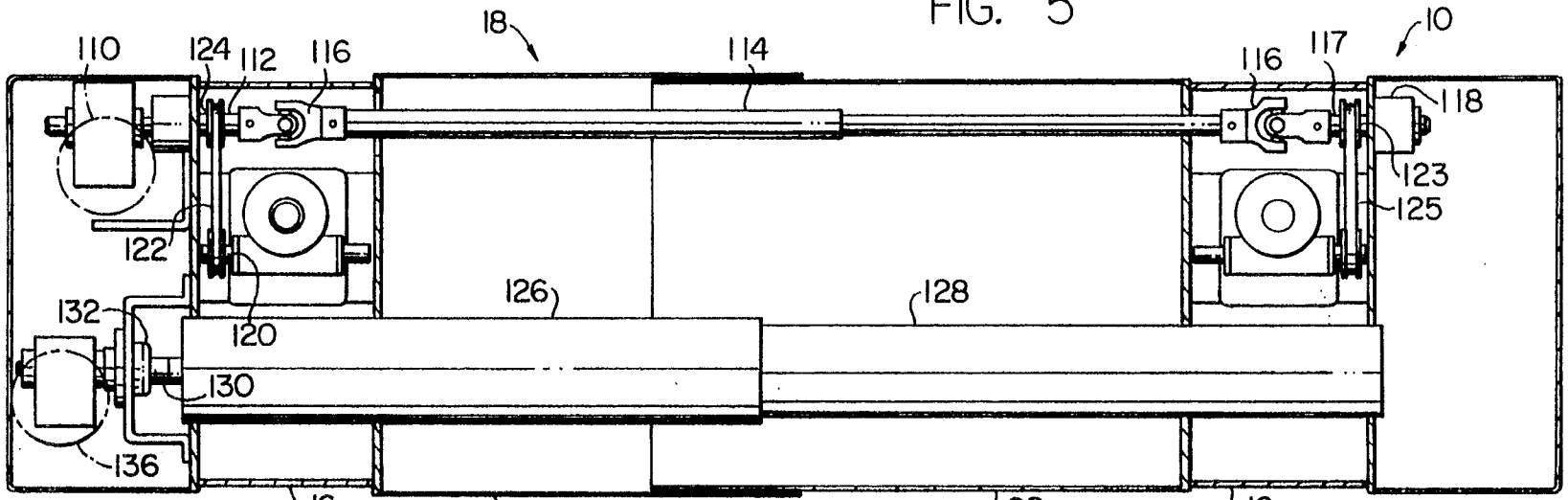
FIG. 6 is a top plan view of the apparatus of FIGS. 1A and 1B, illustrating in further detail the lift motor and drive units for elevating the side frames and the pintle above the ground.

The top frame 18 of the apparatus has a telescopic construction in order to permit lateral movement of the base frames 84 and side frames 16 relative to each other. As shown in FIGS. 1A, 1B and 6, the top frame 18 includes an outer frame member 96 fixedly mounted on one end to the left side frame 16, and an inner frame member 98 received on one end within the outer frame member 96, and fixedly mounted on the other end to the right side frame 16. The side frames 16 are permitted to move laterally relative to each other by movement of the second inner frame 98 within the outer frame member 96 in a telescopic fashion.

Each side frame 16 is driven in the vertical direction by a respective jack screw 100, as shown in FIGS. 1B and 2. Each jack screw 100 is rotatably mounted on one end to a support plate 102 mounted in the top portion of the respective side frame 16, and is mounted on the other end through a jack nut 104 to a respective side support 82. A pair of roller guides 106 are rotatably mounted to each side frame 16, and are seated in contact with the respective side support 82 on opposite sides of the side support relative to each other. Another roller guide 106 is rotatably mounted to the side frame 16, spaced above the other roller guides, and seated in contact with the left side of the support 82 in FIG. 2. The roller guides 106 guide the respective side frame 16 in a vertical path along the surfaces of the side support 82 upon rotation of the respective jack screw 100. A pivot shaft 108, also rotatably mounted to each side frame 16, is spaced above the respective roller guides 106, and is seated in engagement with one side of the respective side support 82, to prevent the side frame 16 from tilting relative to the side support 82.

As shown in FIGS. 1A and 6, a lift motor 110 is mounted on the top portion of the left side frame 16, and includes an output shaft 112 coupled to one end of a telescopic drive shaft 114 by means of a U-joint 116. As shown in FIG. 6, the telescopic drive shaft 114 extends through the first and second tubular members 96 and 98, respectively, and is coupled on the other end to another U-joint 116, which is turn coupled to one end of a drive shaft 117 rotatably mounted to a bearing mount 118 in the top portion of the right side frame 16. The telescopic drive shaft 114 includes two shaft sections, wherein one shaft section is slidably received within the other to permit the drive shaft 114 to increase or decrease in length in a telescopic fashion in response to movement of the side frames 16 laterally relative to each other to accommodate a reel 14 therebetween.

As shown in FIG. 6, each jack screw 100 includes an input shaft 120 located in the top portion of the respective side frame 16 for driving the respective jack screw. The left jack screw 100 in FIG. 6 is coupled to the lift motor 110 by a chain or drive belt 122 and sprocket 124 mounted on the output shaft 112 of the lift motor. The right jack screw 100 in FIG. 6 is coupled to the drive shaft 117 by a sprocket 123 mounted on the drive shaft, and a chain or drive belt 125 coupled to the sprocket. Operation of the lift motor 110 rotates the drive shaft 112, which in turn rotates the input drive shaft of the left jack screw 100 to turn the screw. The drive shaft 112 of the lift motor 110 also simultaneously rotates the telescopic drive shaft 114 and drive shaft 117, which in turn drives the input shaft 120 of the right jack screw to simultaneously rotate the right jack screw in the same direction of rotation as the left jack screw. Depending upon the direction of rotation of the lift motor 110, both jack screws 100 are simultaneously rotated to either drive the side frames 16 up or down in order to cause a rough alignment of the pintles 12 relative to the center hole of a reel 14, as is described further below.

As shown in FIGS. 1A and 6, a telescopic tube is coupled between the side frames 16, and includes an outer tube 126 mounted on one end to the left side frame 16, and an inner tube 128 received on one end within the outer tube and mounted on the other end to the right side frame 16. The inner tube 128 is movable within the outer tube 126 to permit lateral movement of the side frames relative to each other to fit a reel 14 therebetween. A drive screw 130 extends through the outer tube 126 and is mounted on one end by a bearing mount 132 to the left side frame 16, and is coupled to the inner tube 128 by a flange or nut 134 mounted on the end of the inner tube. A drive motor 136 is mounted on the left side frame 16 and is coupled to the drive shaft 130 to rotatably drive the shaft. Operation of the drive motor 136 causes rotation of the drive shaft 130, which in turn moves the inner tube 128 within the outer tube 126 to move the side frames 16 laterally relative to each other. Depending upon the direction of rotation of the drive motor 136, the side frames 16 can be moved toward or away from each other to adjust the space between the side frames to accommodate a reel.

As shown in FIGS. 1A and 1B, a drive arm 138 is coupled to each pintle housing 32, and located between the end of the pintle housing and the respective pintle 12. Each drive arm 138 includes a handle (not shown) which can be gripped by an operator to manually align the respective pintle 12 with the center hole of a reel 14, and to insert the pintle into the center hole once it is aligned. A control panel 140 is mounted on the right side frame 16 in FIG. 1B, and is coupled to each of the motors 54,90,110,136, and to the cylinder 44 to control the operation of the apparatus 10.

In the operation of the apparatus 10, the side frames 16 and top frame 18 are elevated by actuation of the lift motor 110 to a height sufficient to fit the reel 14 beneath the top frame. The drive shaft 112 of the lift motor 110 simultaneously drives both the input shaft 120 of the left jack screw 100, and the telescopic shaft 114 and drive shaft 117, which in turn simultaneously drives the input shaft 120 of the right jack screw 100. Depending upon the direction of rotation of the lift motor 110, the jack screws 100 are simultaneously rotated to either drive the side frames 16 and top frame 18 up, or to lower the side frames and top frame under the force of gravity.

The drive motor 136 is also operated to move the left side frame 16 laterally relative to the right side frame 16 in order to provide a sufficient space between the side frames to fit the reel 14 therebetween. Actuation of the drive motor 136 rotatably drives the drive shaft 130 to move the inner tube 128 relative to the outer tube 126, and in turn move the left side frame 16 relative to the right side frame. Depending upon the direction of rotation of the drive motor 136, the side frames are driven laterally either toward or away from each other.

Once the top frame 18 is elevated to a height sufficient to fit the reel 14 beneath the top frame, and the distance between the side frames 16 is adjusted to fit the reel 14 therebetween, the reel is then placed beneath the top frame so that the center hole of the reel is roughly aligned with the vertical plane extending between the pintles 12. The pintles 12 are then roughly aligned in the vertical plane with the center hole of the reel 14, if necessary, by actuating the lift motor 110 to drive the side frames 16 and pintles 12 either up or down, as needed.

Once this rough alignment procedure is completed, the operator then grips the drive arm 138 of each pintle 12 and manually aligns each pintle with the respective end of the center hole of the reel. Because each pintle 12 is coupled to a respective linkage assembly 24 and suspended by springs 38, each pintle can be manually moved by an operator in any direction within its respective pintle aperture 20 to align the pintle with the center hole of the reel and insert the pintle into the center hole.

Once each pintle 12 is fully inserted into the center hole of the reel 14, the lift motor 110 is operated to drive the side frames 16 upward so that the cradle 22 of each pintle aperture 20 is driven into engagement with the respective pintle to support the pintles and the reel 14 seated on the pintles. Once the drive pintle 12 is seated within the respective cradle 22 under the weight of the reel 14, the cylinder 44 is actuated to drive the fork 50 into engagement with the shaft 30, and thus lock the linkage assembly 24 and drive pintle 12 in place. The lift motor 110 is actuated to lift the reel 14 to a sufficient elevation above ground for transportation, payoff and/or take-up of the reel.

For payoff and take-up of the reel 14, the drive motor 54 is operated to drive the drive pintle 12, which in turn causes rotation of the reel. Depending upon the direction of rotation of the drive motor 54, the reel 14 is rotatably driven for either payoff or take-up of the reel.

One advantage of the apparatus of the present invention, is that because the drive pintle 12 is independently mounted with respect to the drive motor 54, transmission 58, reducer 62, and the other drive components of the drive pintle, the drive pintle can be easily maneuvered by an operator to align the drive pintle with the center hole of the reel. Each of the drive components are fixedly mounted within the side frame 16, and although the drive pintle 12 is coupled to the drive components by means of a chain or drive belt, the drive pintle can be moved with relative ease by manipulating the respective drive arm 126 to align the pintle with the center hole of the reel. In the prior art reeling devices, on the other hand, wherein the drive components are coupled to the drive pintle and suspended with the pintle, the drive pintle is extremely heavy, and thus more difficult to manipulate for alignment purposes in comparison to the drive pintle in the apparatus of the present invention, because the operator is not only moving the drive pintle, but is also required to move the heavy drive components suspended with the pintle. The drive pintle in the apparatus of the present invention is therefore substantially easier to manually manipulate and align in comparison to such prior art devices.

Another advantage of the apparatus of the present invention, is that the pintles are driven relative to the ground to lift the reel above the ground by driving the side frames upward, which in turn drives the cradles into engagement with the pintles and elevates the pintles and the reel above the ground. Accordingly, only one drive motor is necessary to drive both side frames, and thus lift both pintles relative to the ground. This represents a substantial cost savings in comparison to prior art reeling devices requiring separate motors and drive mechanisms for each pintle in order to drive the pintles upward to lift a reel above the ground.

As will be recognized by those of ordinary skill in the art, although a preferred embodiment of the present invention is disclosed in the present specification, numerous modifications may be made to the disclosed apparatus without departing from the spirit of the present invention and the scope of the appended claims. For example, it may be desirable to provide a different drive mechanism than the jack screw to drive the side and top frames in the vertical direction, such as a hydraulic drive mechanism. It may also be desirable to provide a different drive mechanism for rotating the drive pintle, so long as the drive pintle can be moved independent of the drive mechanism for maneuverability and alignment of the drive pintle with the center hole of a reel.

I claim:

1. An apparatus for reeling, comprising:

a first frame member and a second frame member spaced apart from the first frame member, the first and second frame members being movable relative to each other for receiving a reel between them;

a pintle drive motor mounted on the first frame member and fixed with respect to the first frame member; and a drive pintle rotatably mounted on a support member and coupled to the drive motor for rotation of the drive pintle in response to operation of the drive motor for rotation of a reel supported on the drive pintle, the support member being coupled to the first frame member and movable with the drive pintle in at least two directions within a vertical plane relative to the first frame member and the drive motor to align the drive pintle with the center hole of a reel.

2. An apparatus as defined in claim 1, wherein the first frame member includes a support surface located on a side of the first frame member facing the second frame member and below the drive pintle, for engaging the drive pintle upon movement of the first frame member relative to the ground to lift the drive pintle and a reel supported on the drive pintle relative to the ground, and the drive pintle is movable in at least two directions relative to the support surface for aligning the drive pintle with the center hole of a reel.

3. An apparatus as defined in claim 2, further comprising means for driving the first and second frame members relative to the ground for lifting the drive pintle and a reel supported on the drive pintle relative to the ground upon engagement of the support surface with the drive pintle.

4. An apparatus as defined in claim 3, wherein the means for driving the first and second frame members includes a first screw member coupled to the first frame member for driving the first frame member relative to the ground in response to rotation of the first screw member, and a second screw member coupled to the second frame member for driving the second frame member relative to the ground in response to rotation of the second screw member.

5. An apparatus as defined in claim 1, further comprising a flexible drive member coupled between the drive pintle and the drive motor for rotating the drive pintle in response to operation of the drive motor, and a first guide member supported on the first support member adjacent to the flexible drive member and spaced apart from the flexible drive member a distance sufficient to permit rotation of the flexible drive member in response to operation of the drive motor, and to prevent uncoupling of the flexible drive member from the drive pintle upon movement of the drive pintle relative to the drive motor.

6. An apparatus as defined in claim 5, wherein the flexible drive member is coupled to an output shaft coupled to the drive motor for rotation of the output shaft and the flexible drive member in response to operation of the drive motor, and a second guide member is mounted adjacent to the output shaft and spaced apart from the flexible drive member a distance sufficient to permit rotation of the flexible drive member in response to operation of the drive motor, and to prevent uncoupling of the flexible drive member from the output shaft upon movement of the drive pintle relative to the drive motor.

7. An apparatus as defined in claim 6, wherein the flexible drive member is at least one of a chain and a drive belt, and each of the first and second guide members is spaced apart from the flexible drive member a distance less than approximately a thickness of the flexible drive member.

8. An apparatus as defined in claim 6, wherein at least one of the first and second guide members defines a guide surface facing the flexible drive member and substantially conforming to the curvature of the flexible drive member.

9. An apparatus as defined in claim 1, wherein the support member includes a first link member pivotally coupled on one end to the first frame member and pivotally coupled on the other end to one end of a second link member.

10. An apparatus as defined in claim 1, further comprising a locking unit coupled between the first frame member and the drive pintle for pressing the drive pintle in engagement with a support surface on the first frame member to prevent movement of the drive pintle relative to the first frame member.

11. An apparatus as defined in claim 10, wherein the locking unit includes a cylinder and a shaft mounted within the cylinder and engageable on one end with the support member, the shaft being movable in response to actuation of the cylinder to engage the support member and in turn press the drive pintle in engagement with the support surface.

12. An apparatus as defined in claim 2, further comprising a second support member coupled to the second frame member, a second pintle rotatably mounted on the second support member, and wherein the second frame member includes a second support surface located on a side of the second frame member facing the first frame member, and the second pintle is located above the second support surface and movable in at least two directions relative to the second support surface to align the second pintle with the center hole of a reel.

13. An apparatus as defined in claim 12, wherein each of the support surfaces at least partially defines a respective pintle aperture extending through a side wall of the respective frame member facing the other frame member and receiving a respective pintle through the aperture, and each pintle is moveable in at least two directions within the respective pintle aperture to align the pintle with the center hole of a reel.

14. An apparatus as defined in claim 12, further comprising means for driving the first and second frame members relative to the ground, and in turn drive the support surfaces into engagement with the pintles to move the pintles relative to the ground and lift a reel supported on the pintles above the ground.

15. An apparatus as defined in claim 14, wherein the means for driving the first and second frame members includes a lift motor coupled to the first and second frame members for substantially simultaneously driving the first and second frame members relative to the ground in response to operation of the lift motor.

16. An apparatus as defined in claim 15, wherein the means for driving further comprises a first drive unit coupled to the first frame member and to the lift motor for driving the first frame member relative to the ground in response to operation of the lift motor, and a second drive unit coupled to the second frame member and to the lift motor for driving the second frame member relative to the ground in response to operation of the lift motor.

17. An apparatus as defined in claim 16, wherein the first drive unit includes a first screw member coupled to the lift motor and to the first frame member, and rotatable in response to operation of the lift motor to drive the first frame member relative to the ground, and the second drive unit includes a second screw member coupled to the lift motor and to the second frame member, and rotatable in response to operation of the lift motor to drive the second frame member relative to the ground.

18. An apparatus as defined in claim 16, further comprising a drive shaft coupled between the drive motor and the second drive unit, and including at least two shaft sections movable relative to each other to adjust the length of the drive shaft in response to movement of the first frame member relative to the second frame member.

19. An apparatus for reeling, comprising:

a first side frame, and a second side frame spaced apart from the first side frame and coupled to the first side frame, the first and second side frames defining a space between them to receive and support a reel, the first side frame including a first support surface, and the second side frame including a second support surface;

a first pintle member rotatably mounted on a first support member coupled to the first side frame, the first pintle member projecting outward from the first side frame above the first support surface and directed generally toward the second side frame, and movable in at least two directions relative to the first support surface for aligning the first pintle member with the center hole of a reel;

a second pintle member rotatably mounted on a second support member coupled to the second side frame, the second pintle member projecting outward from the second side frame and directed generally toward the first side frame, and movable in at least two directions relative to the second support surface for aligning the second pintle member with the center hole of a reel; and a lift motor coupled to the first side frame and to the second side frame for substantially simultaneously moving the first and second side frames relative to the ground, and in turn driving the first and second support surfaces into engagement with the first and second pintle members, respectively, to move the first and second pintle members and a reel supported on the first and second pintle members relative to the ground.

20. An apparatus as defined in claim 19, further comprising a first drive unit coupled to the first side frame and to the lift motor for moving the first side frame relative to the ground in response to operation of the lift motor, and a second drive unit coupled to the second side frame and to the lift motor for moving the second side frame relative to the ground in response to operation of the lift motor.

21. An apparatus as defined in claim 20, wherein the first drive unit includes a first drive screw coupled to the lift motor and to the first side frame and rotatable in response to operation of the lift motor to move the first side frame, and a second drive screw coupled to the lift motor and to the second side frame, and rotatable in response to operation of the lift motor to move the second side frame.

22. An apparatus as defined in claim 20, wherein the lift motor is mounted on the first side frame, and further comprising a drive shaft coupled between the lift motor and the second drive unit and extending between the first and second side frames, the drive shaft including a first shaft section and at least one second shaft section movable relative to the first shaft section to adjust the length of the drive shaft in response to movement of the first side frame relative to the second side frame.

23. An apparatus as defined in claim 19, further comprising a drive motor mounted on the first side frame and coupled to the first pintle member for rotating the first pintle member upon operation of the drive motor for rotating a reel supported on the first pintle member, and means for maintaining a drive connection between the first pintle member and the drive motor upon movement of the first pintle member relative to the drive motor.

24. An apparatus as defined in claim 23, further comprising a flexible drive member coupled between the first pintle member and the drive motor for rotating the first pintle member in response to operation of the drive motor, and the means for maintaining a drive connection includes a first guide member supported on the first support member adjacent the flexible drive member and spaced apart from the flexible drive member.

25. An apparatus as defined in claim 24, wherein the flexible drive member is coupled to an output shaft coupled to the drive motor for rotation of the output shaft and the flexible drive member in response to operation of the drive motor, and the means for maintaining a drive connection further includes a second guide member mounted adjacent to the output shaft and spaced apart from the flexible drive member.

26. An apparatus as defined in claim 25, wherein each of the first and second guide members are spaced apart from the flexible drive member a distance less than a thickness of the flexible drive member.

27. An apparatus as defined in claim 26, wherein each flexible drive member is selected from the group including a chain and a drive belt.

28. An apparatus for reeling, comprising:

a frame defining a space for receiving a reel and supporting the reel from the frame;

a first pin member defining an axis of rotation and suspended on one side of the frame for being received within the center hole of the reel to support the reel on the frame;

a second pin member suspended on another side of the frame relative to the first pin member for being received within the other side of the center hole of the reel relative to the first pin member to support the reel on the frame;

drive means fixedly mounted to the frame and coupled to the first pin member for rotatably driving the first pin member to rotate a reel supported on the first and second pin members;

means for suspending the first pin member on the frame and for permitting movement of the first pin member in at least two directions substantially transverse to the axis of rotation and relative to the drive means to align the first pin member with the center hole of the reel; and means for maintaining a drive connection between the drive means and the first pin member upon movement of the first pin member in the at least two directions relative to the drive means.

29. An apparatus as defined in claim 28, wherein the drive means includes a drive motor and a flexible drive member coupled between the drive motor and the first pin member to rotate the flexible drive member and the first pin member in response to operation of the drive motor, and the means for maintaining a drive connection includes a guide member coupled to the first pin member and spaced away from the flexible drive member a distance less than a thickness of the flexible drive member.

30. An apparatus as defined in claim 29, wherein the flexible drive member is coupled to an output shaft coupled to the drive motor for rotation of the output shaft and the flexible drive member in response to operation of the drive motor, and a second guide member coupled to the output shaft and spaced apart from the flexible drive member a distance less than a thickness of the flexible drive member.

31. An apparatus as defined in claim 28, wherein the frame includes a first support surface located below the first pin member and a second support surface located below the second pin member, and means for driving the first and second support surfaces away from the ground and into engagement with the first and second pin members to move the first and second pin members and a reel supported on the first and second pin members away from the ground.

32. An apparatus for lifting reels, comprising:

a first side frame, and a second side frame spaced apart from the first side frame, the first and second side frames defining a space between them and being movable laterally toward and away from one another to receive and support a reel, the first side frame also being movable vertically up and down on a first support, and the second side frame also being movable vertically up and down on a second support;

a first pintle member mounted on and projecting outward from the first side frame in a lateral direction generally toward the second side frame for movement with the first side frame and insertion into a center hole of a reel to be lifted, the first pintle member also being mounted from the first side frame for movement relative to the first side frame in at least two directions transverse to the lateral direction for aligning the first pintle member with the center hole of a reel;

a second pintle member mounted on and projecting outward from the second side frame in the lateral direction generally toward the first side frame for movement with the second side frame and insertion into a center hole of a reel to be lifted, the second pintle member also being mounted from the second side frame for movement relative to the second side frame in at least two directions transverse to the lateral direction for aligning the second pintle member with the center hole of a reel;

the first side frame also having a cradle disposed below the first pintle member for fixing the first pintle member against movement in the two directions transverse to the lateral direction when the first pintle member falls into the cradle;

the second side frame also having a cradle disposed below the second pintle member for fixing the second pintle member against movement in the two directions transverse to the lateral direction when the second pintle member falls into the cradle; and a lift motor means coupled to the first side frame and to the second side frame for substantially simultaneously moving the first and second side frames relative to the ground, and in turn driving the first and second-pintle members when inserted into the center hole of a reel into the respective cradles, and lifting the reel off the ground.

33. An apparatus for lifting reels as defined in claim 32, wherein the first and second pintle members are resiliently suspended in the first and second side frames above the cradles respectively.

34. An apparatus for lifting reels as defined in claim 32, further including means for locking the first and second pintle members into the cradles.

35. An apparatus for lifting reels as defined in claim 32, wherein each of the first and second pintle members is mounted in the respective side frame by a linkage assembly for movement of each pintle member in the at least two directions transverse to the lateral direction.

36. An apparatus for lifting reels as defined in claim 35, wherein each linkage assembly is suspended within the respective side frame by a spring member.

* * * * *